US005815578A

United States Patent [19]

Foster et al.

[11] Patent Number: 5,815,578

[45] Date of Patent: Sep. 29, 1998

[54] METHOD AND APPARATUS FOR CANCELING LEAKAGE FROM A SPEAKER

[75] Inventors: Scott H. Foster, Sunol; Martin J. Walsh, Palo Alto, both of Calif.

[73] Assignee: Aureal Semiconductor, Inc., Fremont, Calif.

[21] Appl. No.: 785,200

[22] Filed: Jan. 17, 1997

[51] Int. Cl.[6] ..... H04R 5/02; G10K 11/16

[52] U.S. Cl. ..... 381/1; 381/303; 381/71.1; 381/71.2

[58] Field of Search ..... 381/1, 24, 77, 381/71.1, 303, 71.2

[56] References Cited

U.S. PATENT DOCUMENTS

| | | | |
|---|---|---|---|
| 4,309,570 | 1/1982 | Carver | 381/1 |
| 4,630,298 | 12/1986 | Polk et al. | 381/1 |
| 4,980,914 | 12/1990 | Kunugi et al. | 381/1 |

*Primary Examiner*—Forester W. Isen
*Attorney, Agent, or Firm*—Beyer & Weaver, LLP

[57] ABSTRACT

A system and method are disclosed for canceling the leakage from a speaker.

20 Claims, 17 Drawing Sheets

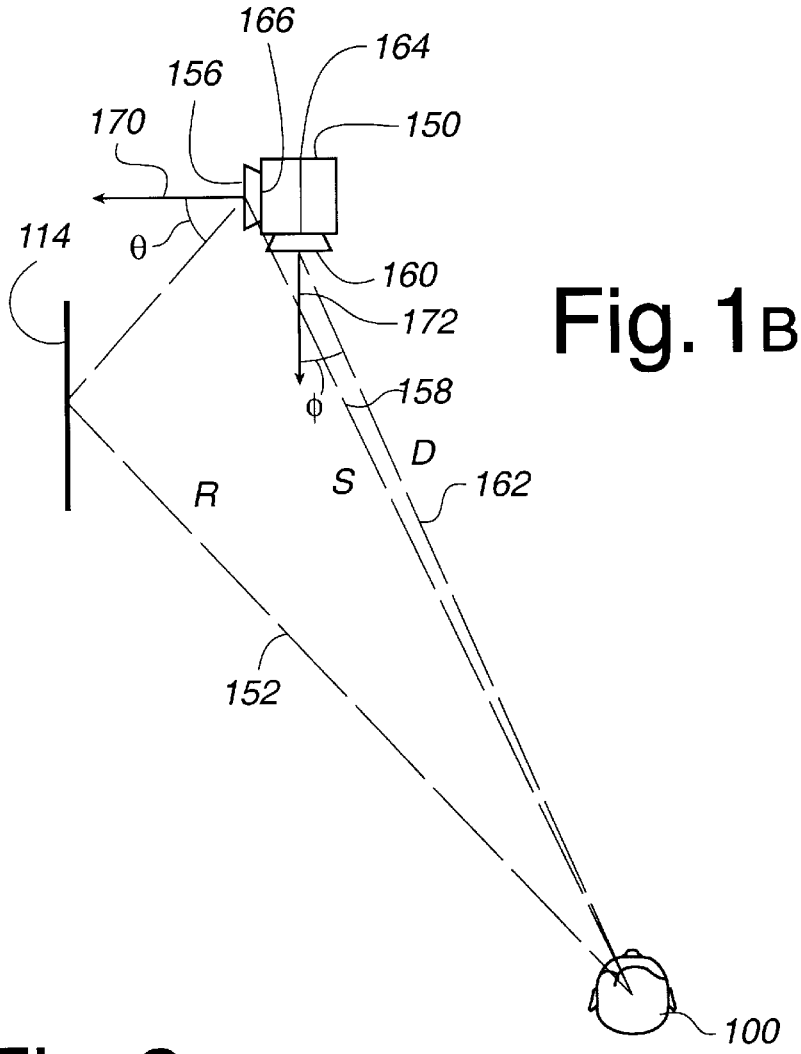
Fig. 1B
Fig. 2A
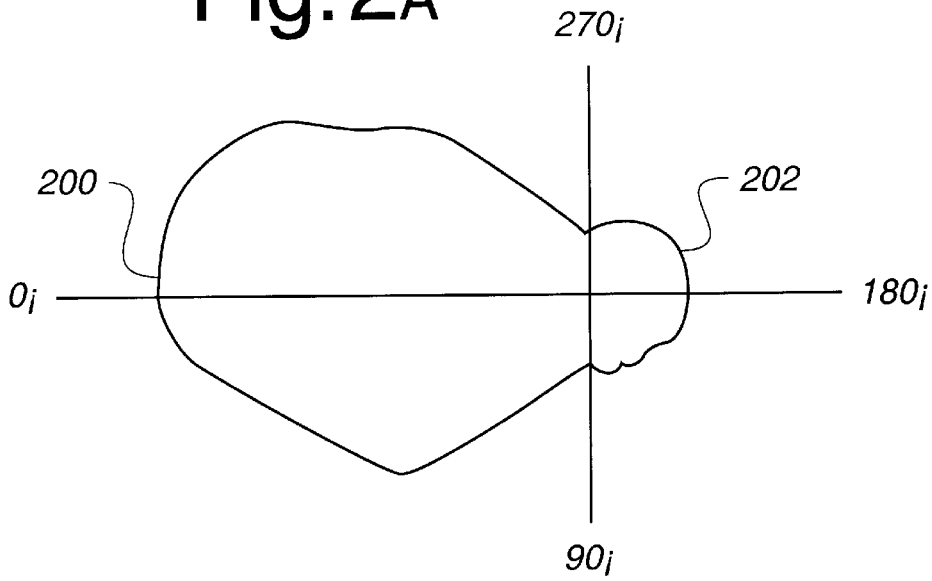

METHOD AND APPARATUS FOR CANCELING LEAKAGE FROM A SPEAKER

BACKGROUND OF THE INVENTION

The present invention relates generally to audio speaker technology, and specifically to a method and apparatus for canceling sound energy which leaks from a directional speaker in a direction other than the direction in which sound energy is intended to be radiated.

There are numerous sound system applications where it is desirable to direct sound in a certain direction. A speaker which is capable of directing sound in one preferred direction to the exclusion of other directions may be referred to as an anisotropic, or directional speaker. While the performance of various directional speakers varies, it is generally true that some leakage of sound energy occurs in directions other than the desired direction. This leakage is usually greater at low frequencies. Larger speakers tend to provide more directionality and less leakage than smaller speakers. However, it is often not practical or desirable to provide large speakers. In some cases, the high frequency performance of small speakers is superior. Leakage can be a significant problem in applications where small speakers are used to direct sound in a particular direction.

One such system is a surround sound speaker array that is designed to envelope the user with surround sound energy reflected from the user environment. Surround sound systems often radiate energy toward the listener along an indirect or reflecting path which includes a reflecting surface that bounces the surround sound energy toward the listener so that the sound appears to have emanated from the direction of the reflecting surface. Leakage of the surround sound energy along a direct path to the listener tends to occur as well as a result of energy leaking from the speakers in that direction. Typically, speaker layouts which rely on the use of environmental reflections suffer from reduced effectiveness due to imperfect control over sound leakage along the direct path from the surround speaker to the listener.

The direct leakage problem is made more serious as a result of a psychoacoustic phenomenon known as the Haas effect or the precedence effect. This effect is described in detail in Blauart, J., *Spatial Hearing* MIT Press Cambridge, Mass. 1983, which is herein incorporated by reference. When a sound is heard followed by similar sounds or echoes, the human perception of direction from which the sound emanates is strongly weighted toward the direction of the first sound to reach the listener, hence the name "precedence effect." This effect enables a person, for example, to pinpoint the direction of a sound which emanates from a room with echoes, since the sound traveling along a direct path reaches the person first.

Generally, when multiple echoes of a sound are presented within a few milliseconds, (up to about 70 ms) the perception of direction is derived from the first (direct) path and the directional characteristics of the later echoes are not significant. Because the leakage signal in a surround sound system as described above takes a direct path to the listener, it tends to unduly influence the listener's perception of the direction of the sound so that the listener tends to perceive the sound as emanating from the surround speaker and not from the desired direction of the reflecting surface. This tends to occur even if the direct leakage signal is significantly attenuated compared to the reflected signal. The problem is exacerbated by the fact that the side energy must propagate first to a reflecting surface, be imperfectly reflected and then propagate back to the listener. The increased distance as well as the imperfect reflection reduces the energy available to 'capture' the directional perception of the user away from the earlier direct path leakage.

Arrangements exist in which the surround speakers are contained in a separate speaker enclosure which is placed behind the listening area. The surround speaker enclosure directs the surround sound to reflecting surfaces behind the listening area. Recently, manufacturers have produced a variety of speakers using a specific side firing layout for a pair of surround speakers included in a pair of speaker enclosures located in front of the listener. This layout includes on the left side and the right side a front speaker housed together with a side-firing speaker in a single speaker enclosure. The enclosure contains a main driver (and in some cases, a tweeter) in the front as well as a side firing or reflecting speaker in the side of the enclosure pointed roughly 90 degrees to the outside, that is, the right side speaker enclosure has a speaker on the right side and the left side speaker enclosure has a speaker on the left side. Throughout this specification for the purpose of illustration the side firing speaker will be shown oriented 90 degrees relative to the direct or front speaker It should be noted that other angles would be similarly treated.

The intent is that the surround signals are directed toward the sides where they can be reflected by a wall or other surface, returning to the listener with a perceived lateral directionality. This design is very sensitive to the positioning (and, in particular, the existence) of the reflection walls. However, even if these reflection surfaces are present, the design is sub-optimal because some of the energy from the side speaker leaks around the front of the enclosure to arrive at the listener position via a direct path. Although this direct path is attenuated considerably with respect to the energy directed toward the side reflection wall, it still tends to capture the directional perception of the listener because of the precedence effect as described above. In certain instances, in order to limit the frontward leakage of side-firing speakers, speaker manufacturers have taken the approach of pointing the side-firing speakers at an angle greater than 90 degrees from the front speakers, in a partially backwards direction. This design is undesirable because the amount of energy usefully reflected from the lateral reflecting surfaces is reduced as well.

A designer could attempt to suppress the strengths of the surround sound leakage signal by specifying surround sound speakers which radiate anisotropically very strongly in the direction towards the reflecting surfaces and radiate only a severely attenuated signal along the direct leakage path. There are limits, however, to the degree of attenuation which may be obtained by available speakers. Generally, at frequencies below about 5 kHz sufficient attenuation is not reliably attainable. Furthermore, since the propagation path of the surround sound signal is longer than the leakage signal, the desired signal is attenuated relative to the leakage signal according to an inverse square law. It is also difficult to cause small speakers to radiate in a strongly anisotropic manner and it is often desirable to use small speakers in a system for space and aesthetic considerations. Another way of suppressing the leakage signals is needed so that the perception of the listener of the surround sound is not ruined by the precedence effect. It would be desirable if such a suppression method and apparatus could suppress the direct leakage sound further below the reflected surround sound signal received by the listener. The performance of reflection surround speaker systems could thus be improved by suppressing the undesired direct path leakage of the surround speakers into the listening area.

SUMMARY OF THE INVENTION

Accordingly, the present invention provides a system and method for suppressing surround sound leakage signals so that the perception of a listener that the surround sound signal is emanating from a reflecting surface is not disturbed. In one embodiment, leakage is canceled for a multiple speaker system having a first speaker which is configured to transmit a reflected sound signal to a listener along a reflected path and a second speaker which is configured to transmit a direct sound signal to the listener at a location along a direct path. The method reducing the listener's perception of a direct leakage signal from the first speaker includes applying a first speaker input signal to the first speaker, the first speaker having a direct leakage transfer function relative to the listener. The direct leakage transfer function is characterized by a transformation which transforms the first speaker input signal into a first speaker leakage signal at the location of the listener by the radiation of the signal by the first speaker and the propagation of the radiated signal to the listener along a direct path from the first speaker to the listener. A second electrical signal which is derived from the first speaker input signal through a system which has a leakage canceling transfer function is processed. The leakage canceling transfer function is characterized by a transformation which transforms the second electrical signal into a canceling transmission signal which has the property of canceling the first speaker leakage signal at the location of the listener when the canceling transmission signal is transformed into a leakage canceling signal at the location of the listener as a result of being transmitted by the second speaker and propagated to the listener. The canceling transmission signal is applied to the second speaker, whereby the transmission and propagation of the of the canceling transmission signal from the second speaker to the listener tends to cancel the effect of the direct leakage transmission and propagation of the first input signal from the first speaker.

These and features and advantages of the present invention will be presented in more detail in the following specification of the invention and the figures.

BRIEF DESCRIPTION OF THE DRAWINGS

FIG. 1B illustrates the transfer functions associated with the transmission and propagation of signals from a speaker enclosure to listener.

FIG. 2A illustrates a plot of the magnitude of the signal transmitted anisotropically from a typical reflecting speaker.

DETAILED DESCRIPTION OF THE INVENTION

Reference will now be made in detail to the preferred embodiment of the invention. An example of the preferred embodiment is illustrated in the accompanying drawings. While the invention will be described in conjunction with that preferred embodiment, it will be understood that it is not intended to limit the invention to one preferred embodiment. On the contrary, it is intended to cover alternatives, modifications, and equivalents as may be included within the spirit and scope of the invention as defined by the appended claims.

Figure 1A:
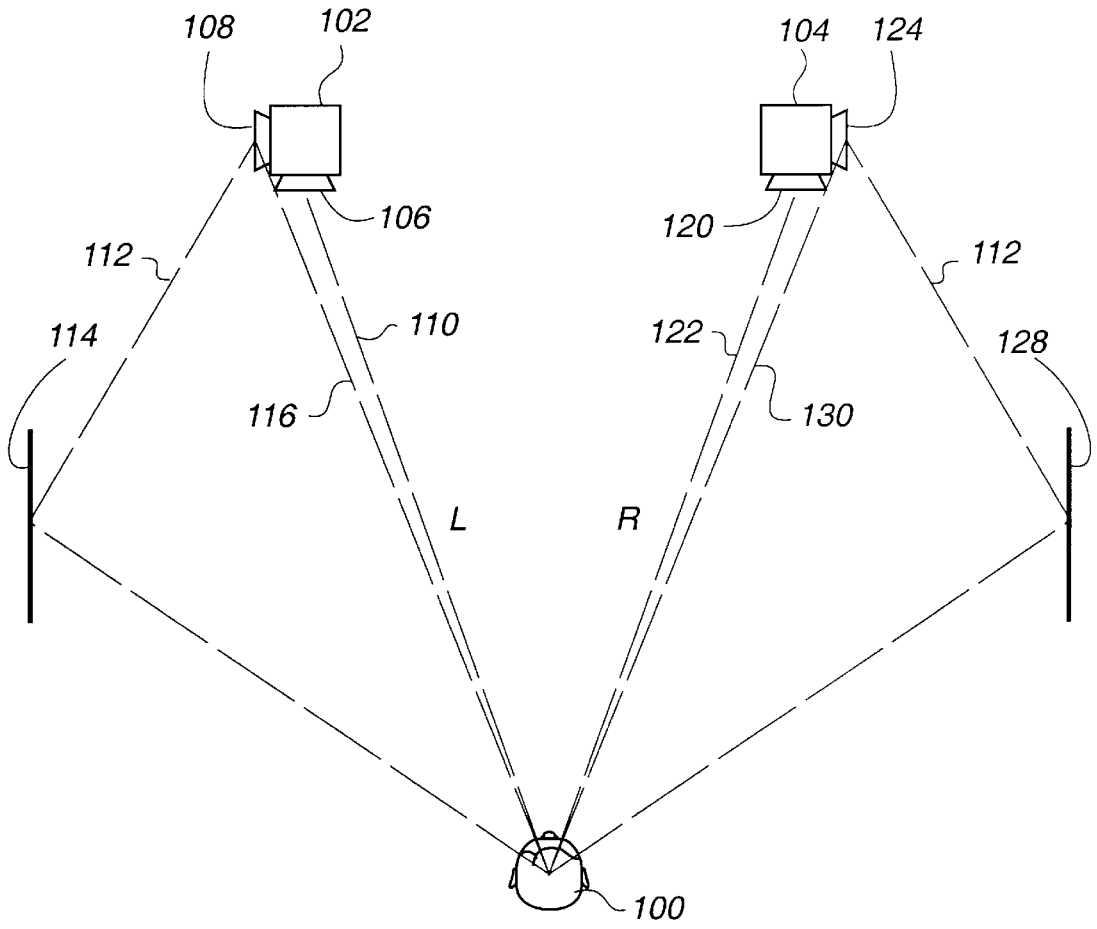
FIG. 1A illustrates a speaker system where two side-firing speakers are used to create a surround effect.

FIG. 1A illustrates a speaker system where two side-firing speakers are used to create a surround effect. A listener 100 is listening to a left speaker unit 102 and a right speaker unit 104. Left speaker unit 102 includes a direct speaker 106 and a side-reflecting speaker 108. A left stereo signal 110 from direct speaker 106 is a left stereo signal, L. A left reflected surround sound signal 112 emanates from 108 and reaches listener 100 after bouncing off of a reflecting surface 114.

Thus, listener 100 receives left stereo signal 110 via a direct propagation route. Left reflected surround sound signal 112 is reflected from a surface to the left of left speaker unit 102 so that it appears to have emanated from a source in that direction. Side-reflecting speaker 108 however, is not perfectly directional and radiates signals other than left reflected surround sound signal 112 which are propagated to listener 100 via different paths. For example, left surround sound leakage signal 116 is propagated directly to listener 100 along the path shown.

Left surround sound leakage signal 116 causes a perceptual problem for listener 100, which may prevent listener 100 from perceiving the direction from which left reflected surround sound signal 112 is supposed to emanate. Because left surround sound leakage signal 116 takes a more direct path to listener 100, left surround sound leakage signal 116 is heard before left reflected surround sound signal 112. In certain embodiments, it is true that side-reflecting speaker 108 radiates sound anisotropically in a manner that left surround sound leakage signal 116 is attenuated relative to left reflected surround sound signal 112. However, because left surround sound leakage signal 116 reaches listener 100 before left reflected surround sound signal 112, listener 100 may nevertheless be more strongly influenced by the direction of left surround sound leakage signal 116 because of the precedence effect as described above.

Likewise, a direct speaker 120 transmits a right stereo signal 122 to listener 100 along the direct propagation path shown. Side reflecting speaker 124 bounces a right reflected surround sound signal 126 off of a reflecting surface 128. A right surround sound leakage signal 130 is also transmitted from reflecting speaker 124 to listener 100 along the direct propagation path shown. It should be noted that in the description below, cancellation of the left signal is described for the purpose of illustration. A person of ordinary skill will recognize that the description applies also to the cancellation of a right leakage signal.

In one embodiment, the present invention provides a leakage canceling signal which cancels the surround sound leakage signal in the vicinity of listener 100 so that the perception of listener 100 that the surround sound signal is emanating from reflecting surfaces is improved. For the surround sound leakage signal, a leakage canceling signal is generated in the vicinity of the listener by applying a leakage transmission signal to a direct speaker. The leakage canceling signal effectively suppresses the surround sound leakage signal so that it does not disturb the listener's perception. The leakage transmission signal is derived as described below from a measured transfer function which describes the transmission and propagation of the surround sound leakage signal to the vicinity of the listener and the transfer function which describes the transmission and propagation of a direct signal to the listener.

FIG. 1B illustrates the transfer functions associated with the transmission and propagation of signals from a speaker enclosure 150 to listener 100. A transfer function R is associated with a reflected propagation path 152 which includes reflecting surface 114. Transfer function R also includes the effect of transmission through a reflecting speaker 156 at an angle which corresponds to propagation path 152. A transfer function S describes the effect of transmitting a signal through reflecting speaker 156 at an angle which corresponds to the propagation of the sound along direct propagation path 158 to listener 100. Transfer function S also describes the effect of the propagation of the signal along propagation path 158. It should be noted that, in general, speaker 156 radiates sound anisotropically so that transfer function S differs from transfer function R not only as a result of the difference in the reflected transmission propagation path from the direct propagation path, but also as a result of the difference in the angle of radiation from reflecting speaker 156 of the sound signals.

It should also be noted that, not only does reflecting speaker 156 radiate anisotropically in certain embodiments, but it is also true that the anisotropic nature of the radiation from reflecting speaker 156 varies as a function of frequency. For example, most speakers tend to radiate relatively isotropically at low frequencies, especially below about 200 Hz. The anisotropic nature of the radiation tends to increase at higher frequencies. Thus, the transfer functions R and S are functions of both of frequency and angle of radiation. For the purpose of this description, angles are measured relative to a propagation path which is parallel to the direction in which a speaker is pointing. This direction is shown by arrow 170 for reflecting speaker 156 and by arrow 172 for direct speaker 160. Angle theta is the angle of transmission for reflecting speaker 156 along propagation path 152. Angle phi is the angle of transmission for direct speaker 160 along propagation path 162.

Direct transfer function D represents the transmission of a signal by direct speaker 160 along a direct propagation path 162 to listener 100. It should be noted that speaker enclosure 150 has not been labeled as either a left or a right speaker unit, although for purposes of illustration, it is depicted as a left unit in FIG. 1B. Speaker enclosure 150 could also have been represented as a right speaker unit, and corresponding transfer functions would then be similarly defined.

The transfer functions S and D are physically measured for the speaker system. S and D can be measured using an anechoic chamber. It is preferred, however, to measure S and D using the techniques described in U.S. Patent application Ser. No. 08/286,873 of Abel and Foster, which is herein incorporated by reference in its entirely for all purposes. Abel and Foster teach a method of measuring head related transfer functions and other similar acoustic transfer functions that does not require the use of an anechoic chamber. The head related transfer function includes the effects of the diffraction of sound by the listener and therefore is a function of the particular shape of the listener's body, head, and ears. There is a head related transfer function associated with each ear.

In certain embodiments, the present invention uses the head related transfer function to determine the exact transfer functions to each of the listener's ears. In other embodiments, the effect of the diffraction of the sound signals transmitted by reflecting speaker 156 and direct speaker 160 by the listener's head are ignored and a single transfer function to the vicinity of the listener's head is used as an approximation of the head related transfer function to each ear. The measurement methods described by Abel and Foster are equally applicable to measuring a single transfer function to the vicinity of the listener's head.

The transfer functions S and D are both complex functions having both a magnitude and a phase that vary with frequency. S and D also change with the position of listener 100. For example, if listener 100 moves in an off-axis direction relative to speaker enclosure 150, then the angle of propagation from reflecting speaker 156 and direct speaker 160 changes. As mentioned above, the transmission characteristics of each of the speakers, for at least some frequencies, is such that they do not radiate isotropically. Both the magnitude spectrum and the phase spectrum of the transfer functions therefore may change with angle. A leakage cancellation system that works for a first pair of transfer functions corresponding to a first position of listener 110 may not work well for other positions of listener 110. It is possible, however, as shown below, to design a leakage canceling transmission signal which effectively cancels leakage signals over a large area in a robust manner. The area in which the system operates effectively for listener 110 is referred to as the sweet spot. A large sweet spot is generally desirable.

In one embodiment, the present invention provides a leakage canceling signal to listener 100. The leakage canceling signal is transmitted by direct speaker 160 along direct propagation path 162. The source of the leakage cancellation signal is a leakage transmission signal 164 which is applied to direct speaker 160 when a first signal 166 is applied to reflecting speaker 156. Leakage canceling transmission signal 164 is derived in a manner so that when it is applied to direct speaker 160, the resulting transmission signal will, after a propagation along direct propagation path 162, exactly cancel the leakage signal caused by the application of surround sound signal 166 to reflecting speaker 156 and transmission and propagation of the leakage signal along direct propagation path 158. The derivation of transmission signal 164 from surround sound signal 166 is detailed below.

In the embodiment shown in FIG. 1B, a direct speaker which is co-located on the same speaker unit as the reflecting speaker which has a leakage signal that is being canceled is used to transmit the leakage canceling signal. (Note that in a side-firing speaker embodiment, the direct speaker functions both to transmit one of the stereo channel signals as well as to transmit the canceling transmission signal.) In certain embodiments, the direct speaker and the reflecting speaker are located not only in the same speaker enclosure, but also horizontally in the same position, one located on top of the other, for reasons that are explained below.

Because direct speaker 160 is located close to reflecting speaker 156, the leakage cancellation signal and the leakage signal emanate from approximately the same location along approximately the same path. Changes in the propagation paths for S and D to the listener tend to be similar when a canceling transmission signal is transmitted and propagated from direct speaker 160 to listener 100. For example, changes in the attenuation of signals and changes in phase as a result of the distance to listener 100 are substantially the same as long as the two speakers are close together relative to the distance to listener 100. It is thus possible to create a relatively large sweet spot by taking into account the angular transmission variances in the speakers.

FIG. 2A illustrates a plot of the magnitude of the signal transmitted anisotropically from a typical reflecting speaker. The power of the radiation is strongly biased in the forward direction with a maximum amplitude at 0 degrees at the center of a front lobe 200. A back lobe 202 represents attenuated leakage radiation. In systems without leakage canceling, the main concern with back lobe 202 is that it be as small as possible relative to front lobe 200. Specifically, the power in the back lobe at points between the angles 90 degrees and 180 degrees would need to be approximately 30 dB less than the maximum front lobe power to overcome the precedence effect. (Note that the angles between 90 degrees and 180 degrees measured with respect to the reflecting speaker in a side-firing speaker arrangement correspond to the angles between 0 degrees and 90 degrees measured with respect to the front speaker. Unless otherwise noted in this specification, the angle specified will refer to the front speaker.) In certain embodiments of the present invention, however, back lobe 202 can be permitted to be relatively large, and the main concern is that back lobe 202 be roughly uniform or slowly varying as a function of angle.

This is because the leakage signal radiated in the backlobe is canceled. A leakage signal that has been canceled at the listener's location is reduced relative to the reflection signal. If the back lobe does not vary greatly with angle, then the system can produce a larger sweet spot since transfer function S will not change greatly as a result of movement by the listener.

Although the angles 90 degrees to 180 degrees relative to the reflecting speaker are specified above to cover cases where the listener position varies from directly between a pair of speakers to directly in front of one speaker, other angular ranges corresponding to other limits on the listener's position are of interest in certain embodiments. For example, a range between 0 degrees and 30 degrees (or 90 degrees and 120 relative to the reflecting speaker) is significant for positions between a position centered in front of the speakers a few feet away to a position directly in front of one speaker.

Figure 2B:
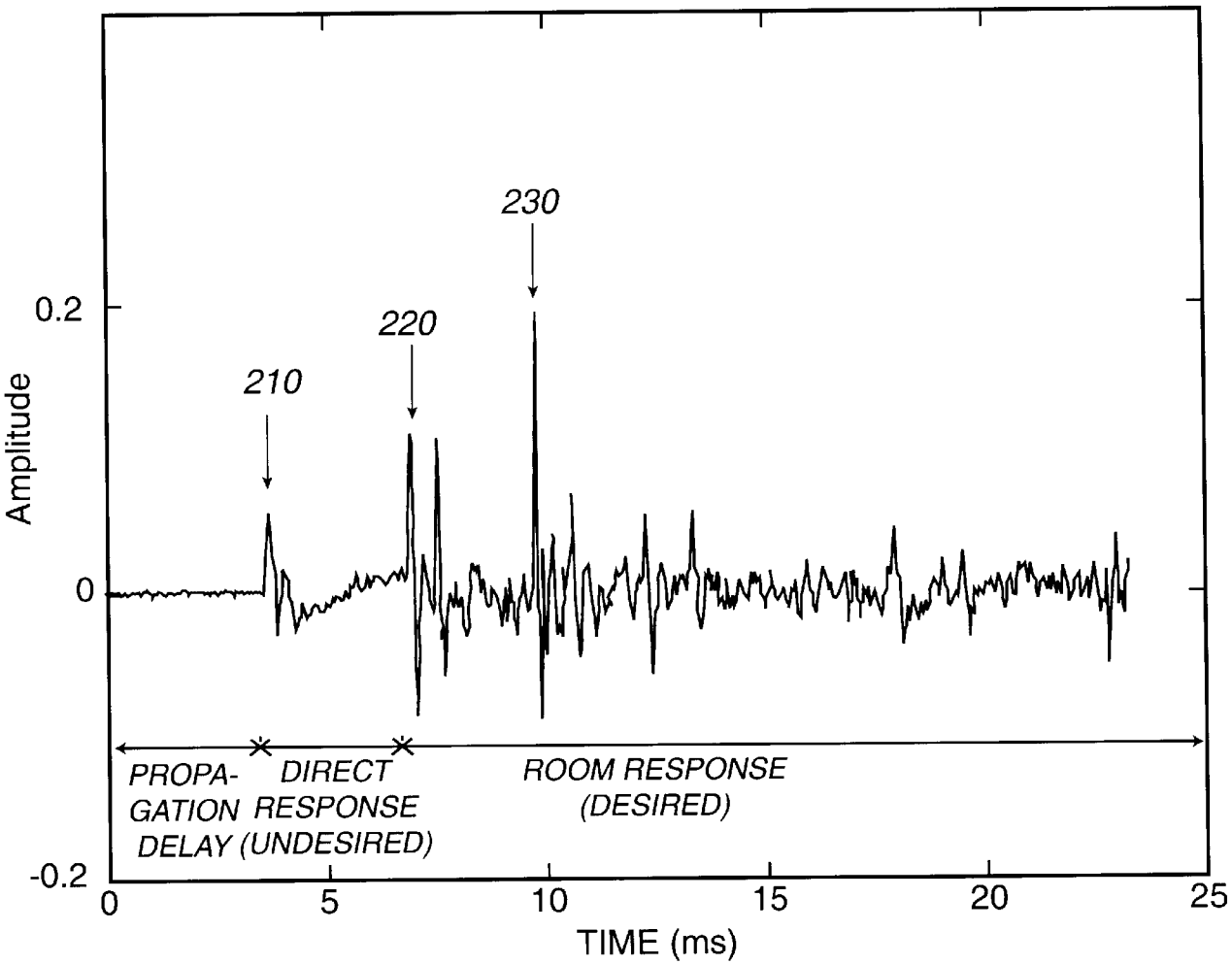
FIG. 2B illustrates an impulse response at a listener location for a reflecting speaker.

FIG. 2B illustrates an impulse response at a listener location for a reflecting speaker. For the first interval of time shown up to a point 210, the response is near zero. This corresponds to the propagation delay that results from the time it takes for the leakage signal to reach the listener. Starting at point 210 at about 4 ms, the direct leakage signal begins to reach the listener. This is the part of the impulse response which is undesirable and will be canceled. About 3 ms later at a point 220, the reflecting signal begins to reach the listener. This is the part of the signal which is desired.

Figure 3:
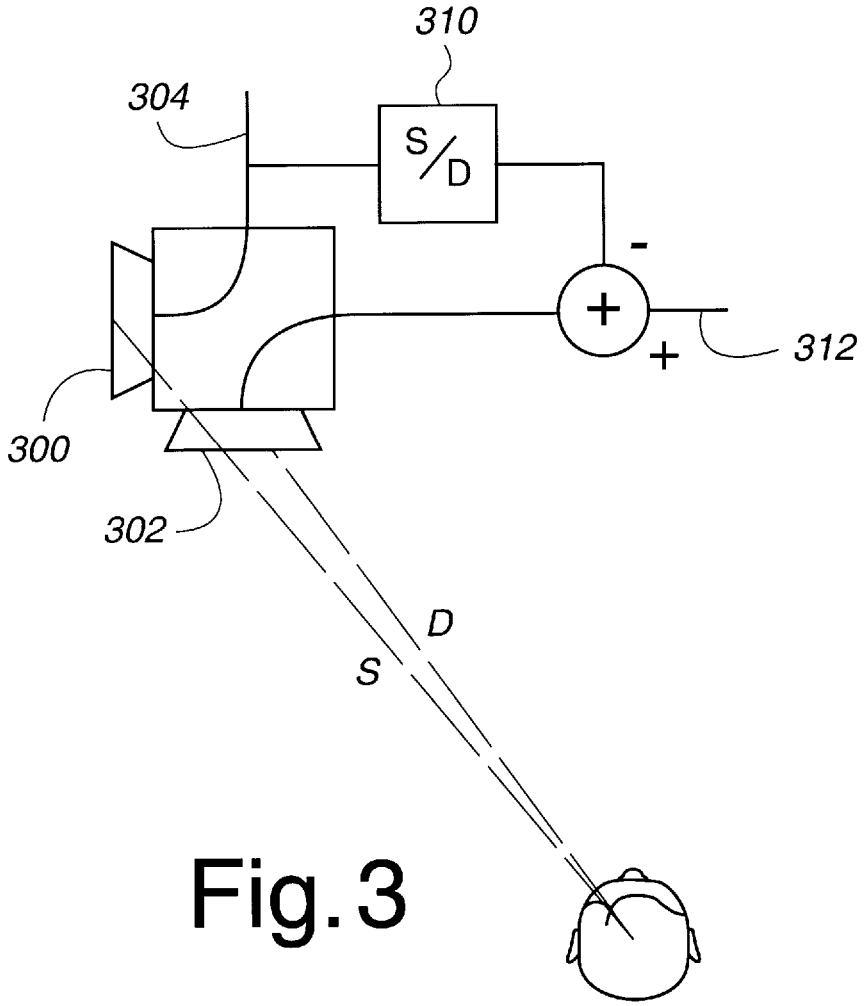
FIG. 3 illustrates a system in which the leakage signal from a reflecting speaker is canceled at the location of listener by transmitting a leakage canceling signal through direct speaker.

FIG. 3 illustrates a system in which the leakage signal from a reflecting speaker 300 is canceled at the location of listener 100 by transmitting a leakage canceling signal through direct speaker 302. A surround sound signal is applied to an input 304 which is connected to reflecting speaker 300. As a result of the transmission of the surround signal by reflecting speaker 300, a leakage signal is propagated to listener 100. The transformation of the surround signal into the leakage signal is described by the transfer function S, which is a complex function having a phase and an amplitude. Input 304 is also connected to a filter 310 which has a transfer function S/D. The output of filter 310 is inverted, combined with input signal 312, and applied to direct speaker 302. Signal 312 is in one embodiment the left channel stereo signal. D is the transfer function which describes the transformation of a signal input to direct speaker 302 as a result of transmission by direct speaker 302 and propagation to listener 100. 1/D is the inverse transfer function of D.

The output of filter 310 is therefore a signal which, when transformed by the transfer function D and inverted, will yield a signal which is the negative of S, that is, a signal which would cancel S. Transmission of the signal by direct speaker 302 and propagation of the signal to listener 310 has the effect of implementing transfer function D. The output of filter 310 is a therefore a leakage canceling transmission signal which, when it is applied to direct speaker 302, will create a leakage canceling signal in the vicinity of the listener.

In one embodiment, filter 310 implements an approximation or model of the theoretical filter transfer function derived from the exact measured transfer functions S and D. The leakage cancellation filter is implemented as a minimum phase filter combined with a pure time delay. Higher frequency components of S and D are not modeled to lower the order of the filter required to implement the system and averaging of S/D over a range of angles is done to provide a filter function which works for a range of angles. The derivation of the filter function is depicted further in FIG. 5 through FIG. 8D.

Referring back to FIG. 2B, there is no need to cancel the signal emanating from the reflecting speaker for time delays less than the time corresponding to point 210. Therefore, the period prior to 210 is windowed out by including a pure delay for both S and D. Eliminating the same amount of propagation delay from S and D does not affect the phase response of S/D. The same amount of propagation time windowed out of D is windowed out of S.

Figure 4A:
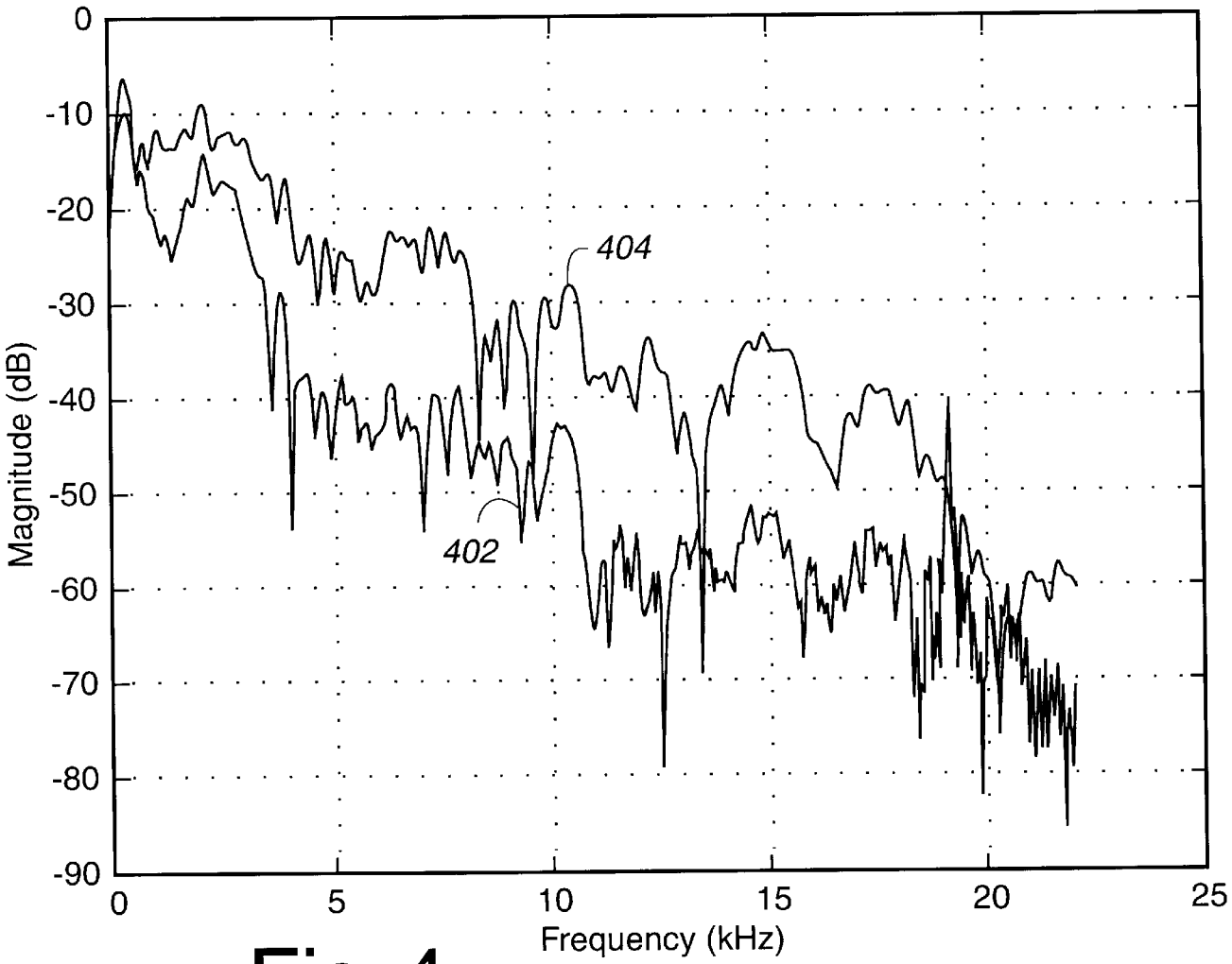
FIG. 4A is a graph which plots the magnitude of S versus frequency as measured for a reflecting speaker.

FIG. 4A is a graph which plots the magnitude of S versus frequency as measured for a reflecting speaker. Curve 402 corresponds to a listener who is located 30 degrees away in a counter clockwise direction from the direction in which a direct speaker is pointed. Curve 404 corresponds to a listener who is located 0 degrees away in a counter clockwise direction from the direction in which a direct speaker is pointed. The similarities between the plots is the result of the relatively slight variance of magnitude of the reflecting speaker leakage output as a function of angle. This is a desirable reflecting speaker characteristic which facilitates the creation of a large sweet spot.

It should be noted that beyond about 7 kHz, the magnitude of S is reduced to about−30 dB. For this reason, it is generally not necessary to cancel the direct leakage signal for frequencies in this range. In addition, in some embodiments the surround sound signals are band limited.

Figure 4B:
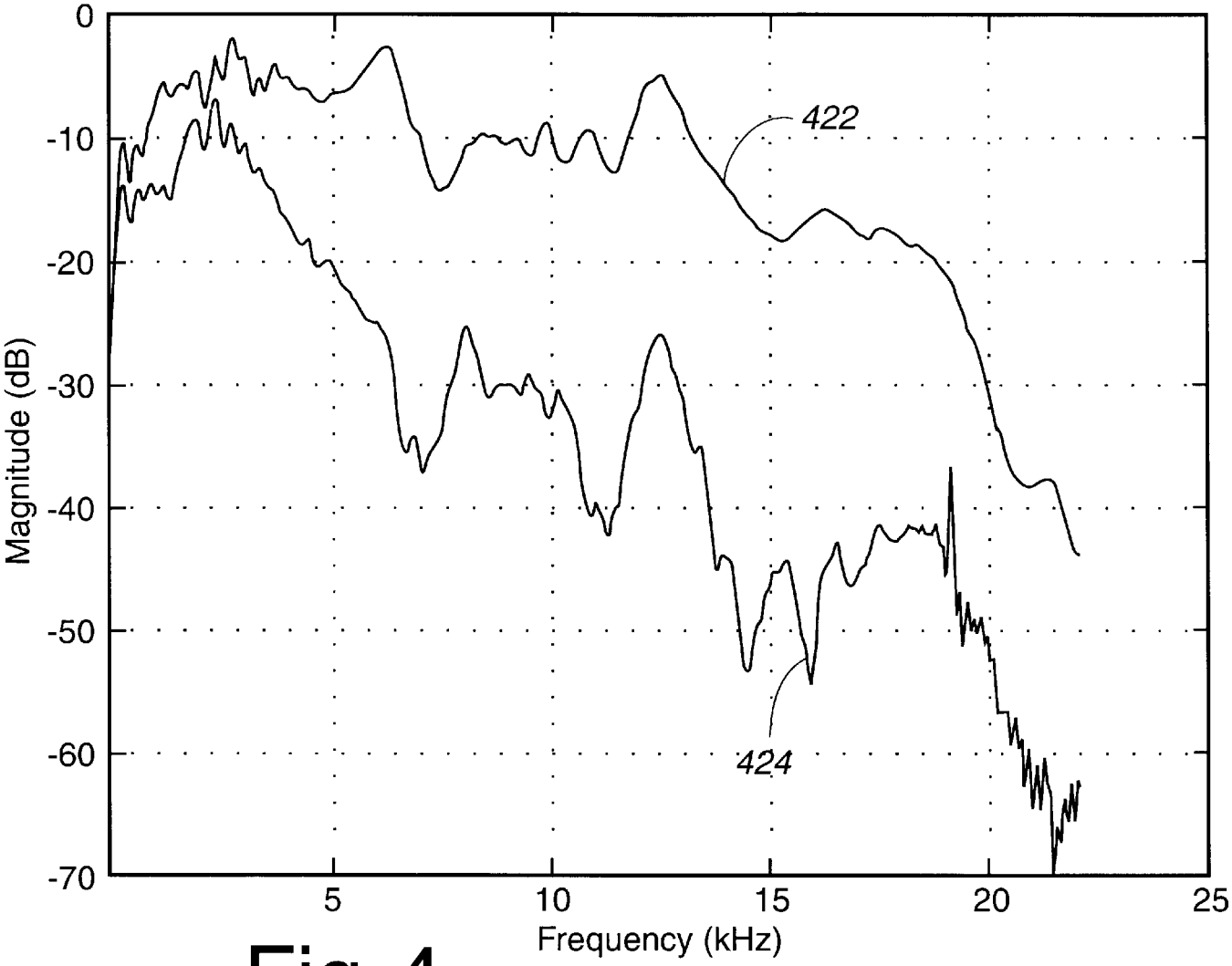
FIG. 4B is a graph which plots the magnitude of D versus frequency measured for a direct speaker.

FIG. 4B is a graph which plots the magnitude of D versus frequency measured for a direct speaker. Curve 422 corresponds to a listener who is located 30 degrees away in a counter clockwise direction from the direction in which a direct speaker is pointed. Curve 424 corresponds to a listener who is located 0 degrees away in a counter clockwise direction from the direction in which a direct speaker is pointed. The similarities between the plots is the result of the relatively slight variance of magnitude of the direct speaker output as a function of angle. This is a desirable direct speaker characteristic which facilitates the creation of a large sweet spot.

The leakage cancellation filter is designed to implement a transfer function which approximates S/D. In one embodiment, the design is carried out by first smoothing the combination, S/D, of the measured transfer functions S and D using a least squares fit. A fifth order curve is used to fit the functions. Other order curves may be used according to the allowable complexity of the leakage cancellation filter. A fifth order filter performs well. Up to a ninth order filter would be practical and as low as a second order filter would give usable performance. A 4th through 8th order filter is preferred. In one embodiment, a least square fit is used to fit the measured transfer function S/D for a single speaker angle. In another embodiment, as described below, transfer functions S/D are fit for a range of speaker angles and an additional difference function is implemented in certain embodiments so that the common peaks found in the transfer functions for different speaker angles are emphasized. Although in the embodiment described above, the combined transfer function S/D is fit, in certain embodiments, S and D are each fit separately using a least squares algorithm.

Figure 5:
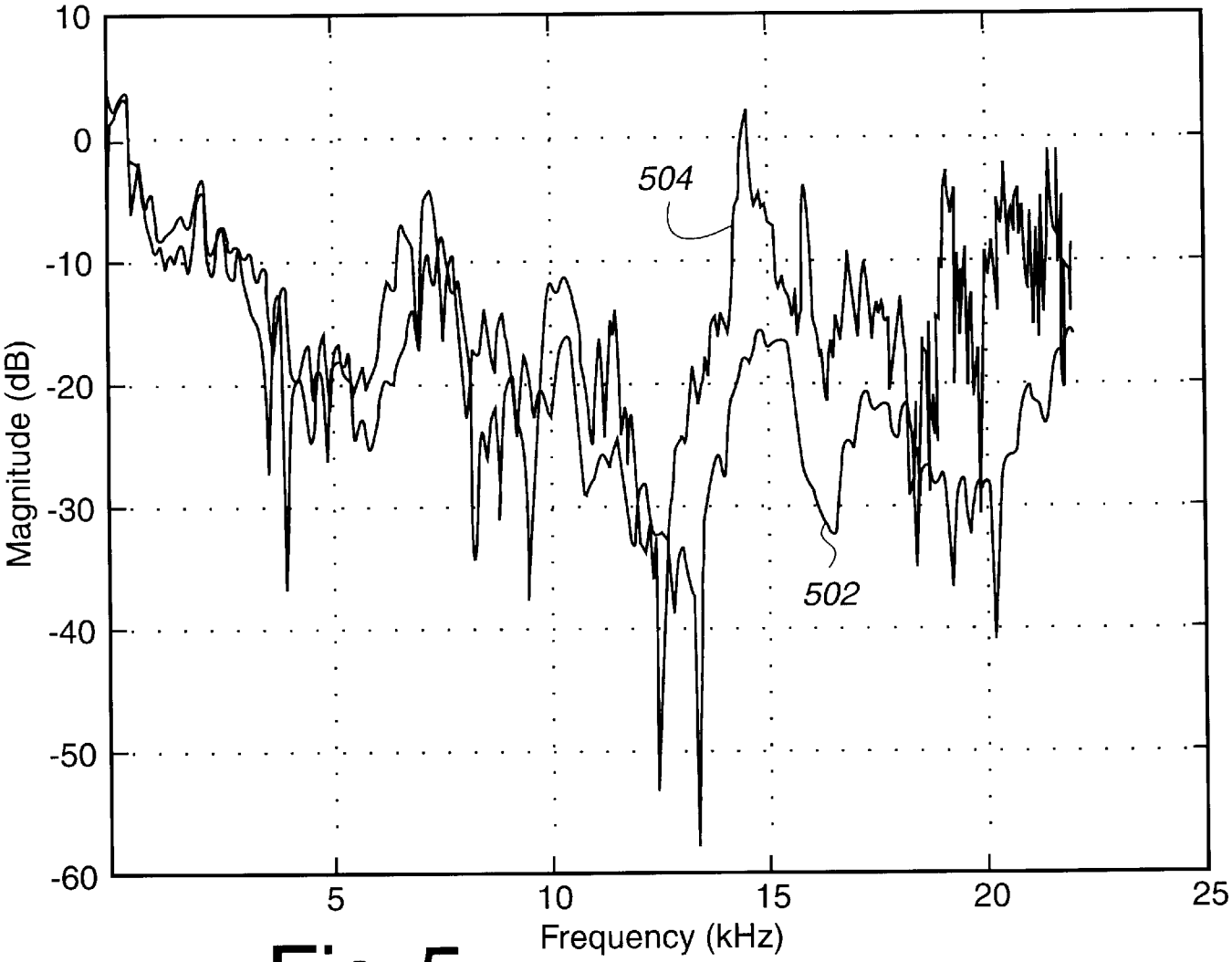
FIG. 5 is a graph which plots the magnitude of a pair of derived cancellation filter responses that implement a transfer function S/D corresponding to a pair of measured transfer functions S and D with no smoothing.

FIG. 5 is a graph which plots the magnitude of a pair of derived cancellation filter responses that implement a transfer function S/D corresponding to a pair of measured transfer functions S and D with no smoothing. Curve 502 shows a cancellation filter response for a direct speaker angle of 0 degrees. An actual cancellation filter which is designed to model this transfer function will be referred to hereinafter as C0. Curve 504 shows a cancellation filter response for a direct speaker angle of 30 degrees. An actual cancellation filter which is designed to model this transfer function will be referred to hereinafter as C30.

Figure 6A:
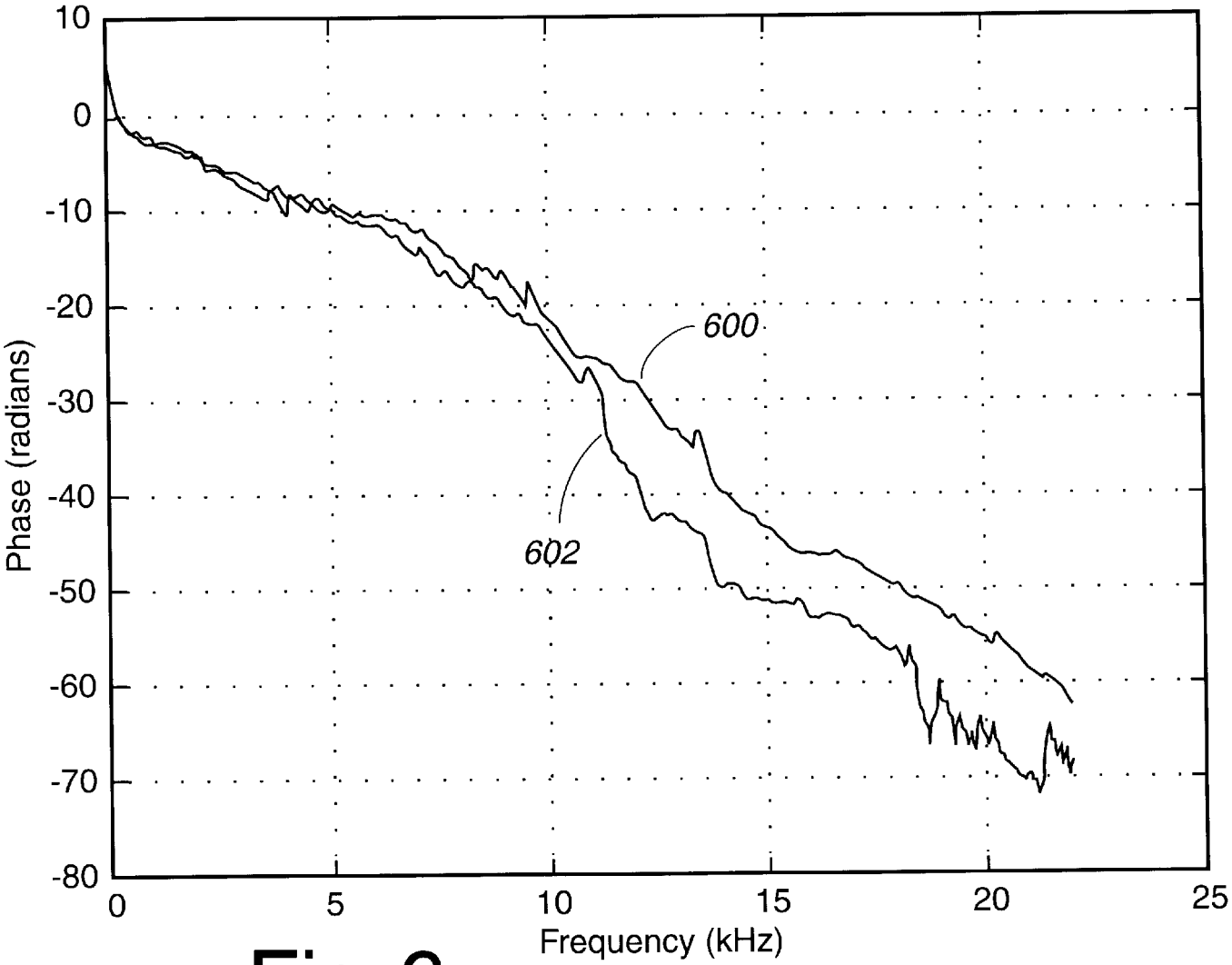
FIG. 6A is a graph which plots the desired phase response of C0, derived from measurements of S/D and the desired phase response of C30, derived from measurements of S/D.

FIG. 6A is a graph which plots on a curve 600 the desired phase response of C0, derived from measurements of SID. A curve 602 plots the desired phase response of C30, derived from measurements of S/D. The phase appears to be reasonably linear up to about 10 kHz, which is beyond the frequency bound of the region of interest. (Recall that the magnitude of S was below 30 dB for frequencies above about 7 kHz. In certain embodiments, a range below 5.5 kHz is determined to be the frequency limit that is of interest.) This suggests that a minimum phase filter plus a pure delay may adequately model S/D for the design of C30.

Figure 6B:
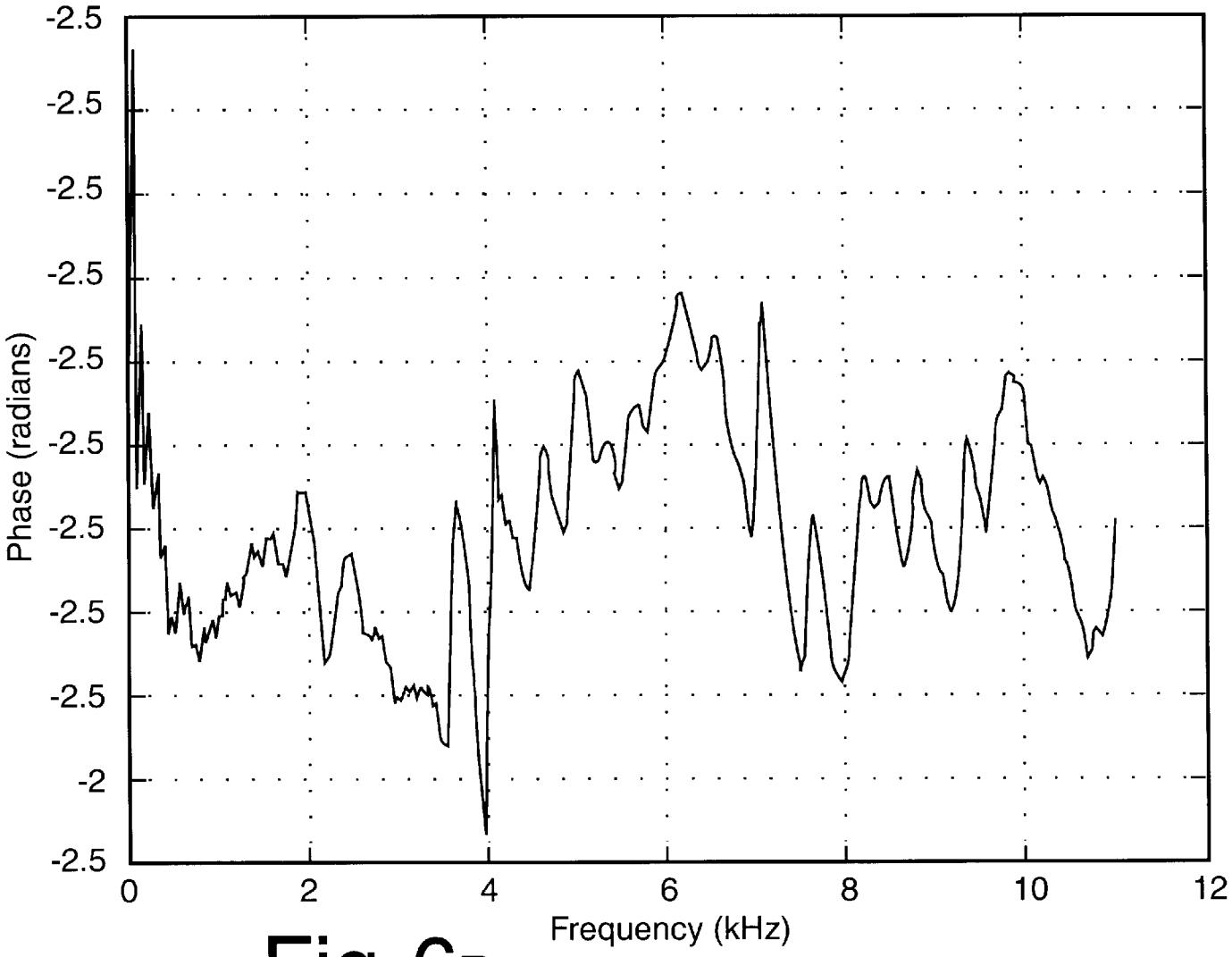
FIG. 6B is a graph which plots the phase response of a minimum phase filter designed to implement S/D with no time delay.
Figure 6C:
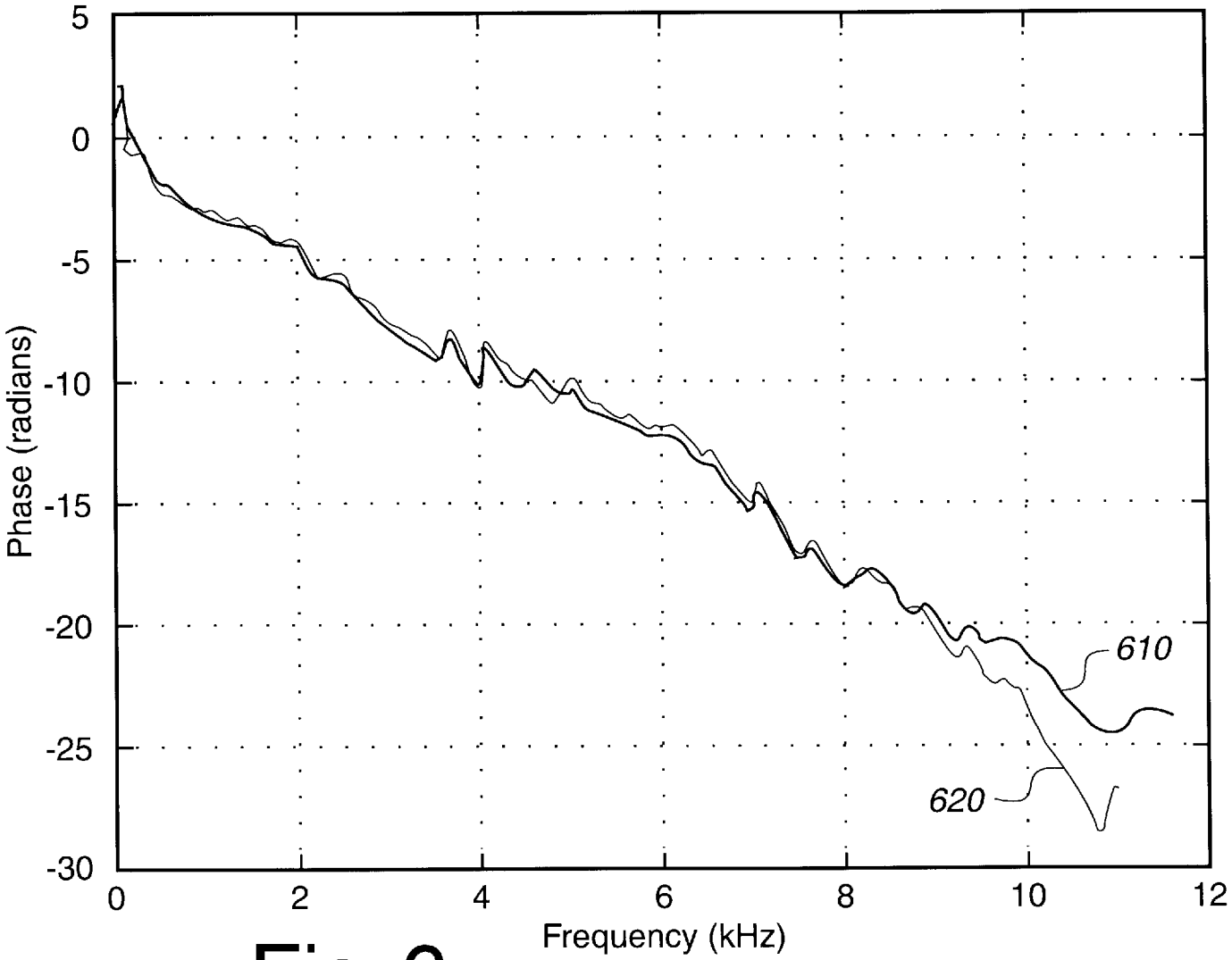
FIG. 6C is a graph which plots the phase response of C30 implemented as a minimum phase filter combined with a pure delay of 15 samples, together with the actual measured phase response of S/D.
Figure 6D:
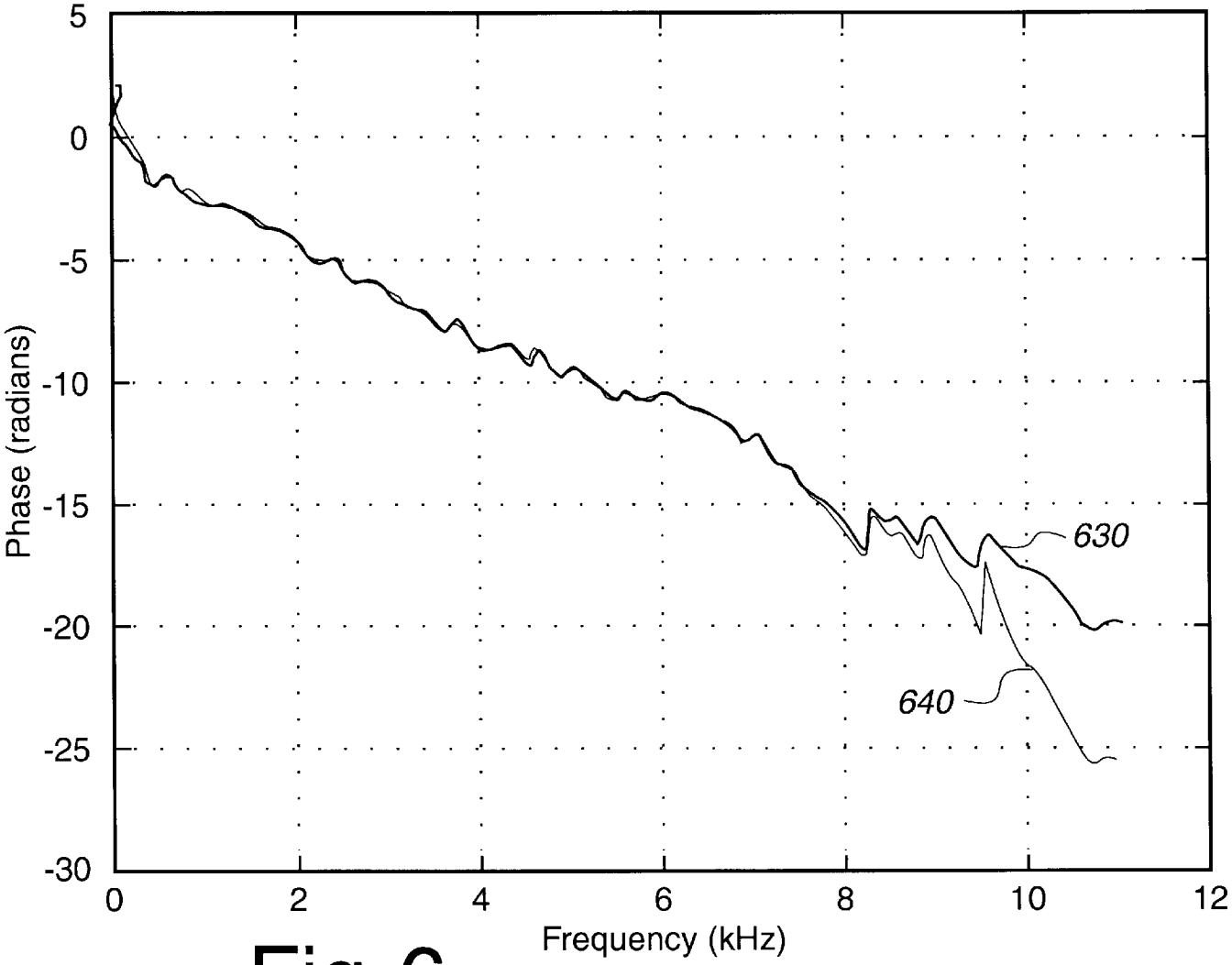
FIG. 6D is a graph which plots the phase response of a filter C0 which is designed to implement the transfer function S/D corresponding to an angle of 0 degrees measured from the direct speaker to the listener.

FIG. 6B is a graph which plots the phase response of a minimum phase filter designed to implement S/D with no time delay. FIG. 6C is a graph which plots the phase response of C30 implemented as a minimum phase filter combined with a pure delay of 15 samples or 0.34 ms in a curve 610, together with the actual measured phase response of S/D in a curve 620. As is evident, the curves match almost perfectly up to about 8 kHz. Thus, C30 may effectively model the theoretical transfer function S/D when implemented using a minimum phase filter plus a pure delay. Similarly, FIG. 6D is a graph which plots on curve 630 the phase response of a filter C0 which is designed to implement the transfer function S/D corresponding to an angle of 0 degrees measured from the direct speaker to the listener. C0 also effectively models the theoretical transfer function S/D when implemented using a minimum phase filter. The pure delay for C0 is 12 samples or 0.272 ms. Curve 640 shows the actual measured phase response of S/D. Again, these curves are nearly the same up to 8 kHz, which is beyond the boundary for the region of interest.

Thus, it has been shown that a filter which implements S/D for 0 degrees or 30 degrees may be implemented using a minimum phase filter and a pure delay. The same is true for other angles both within and outside of the 0 to 30 degree range as well. As the angle changes, only the amount of the pure delay changes.

This change in the pure delay can be explained by referring back to FIG. 1B. The difference in delay between path 158 and 162 is caused by the fact that sound from reflecting speaker 156 must be diffracted around speaker enclosure 150 before it reaches listener 100. As listener 100 moves toward the left and right or forward and backward, then the difference in length between path 158 and path 162 changes. As noted above, in the side firing speaker arrangement tested, the phase change between positions where listener 100 moves from a position that is 0 degrees with respect to direct speaker 160 to a position in which listener 100 is 30 degrees with respect to direct speaker 160, is about a 3 sample delay. In some embodiments, direct speaker 160 and reflecting speaker 156 are co-located on top of each other, in order to minimize changes in the signal delay as listener 100 moves about the room. This enables a single delay to be used to model S/D for any angle. Alternatively, the amount of the delay may be adjusted without disturbing the rest of the filter. Thus, in certain embodiments, a pure delay is set corresponding to a specific speaker/listener geometry according to the position of the listener relative to the speakers. In different embodiments, the delay may be set a priori according to a given design geometry or the delay may be set by the listener based on a measured geometry or the delay may be set by the listener when the directionality of the sound is as desired.

Next, it will be shown that the magnitude of the minimum phase portion of C30 and C0 may be effectively modeled using a fifth order least square curve fit. for frequencies below about 5.5 kHz. Specifically, it will be shown that the minimum phase portions of a filter C30 and a filter C0 may be effectively represented by a single minimum phase filter which fits an average of the minimum phase magnitude responses for the two angles. Only the pure delay component of C30 and C0 needs to be adjusted to accurately implement the measured characteristics of the transfer function S/D for the frequency range of interest.

Figure 7A:
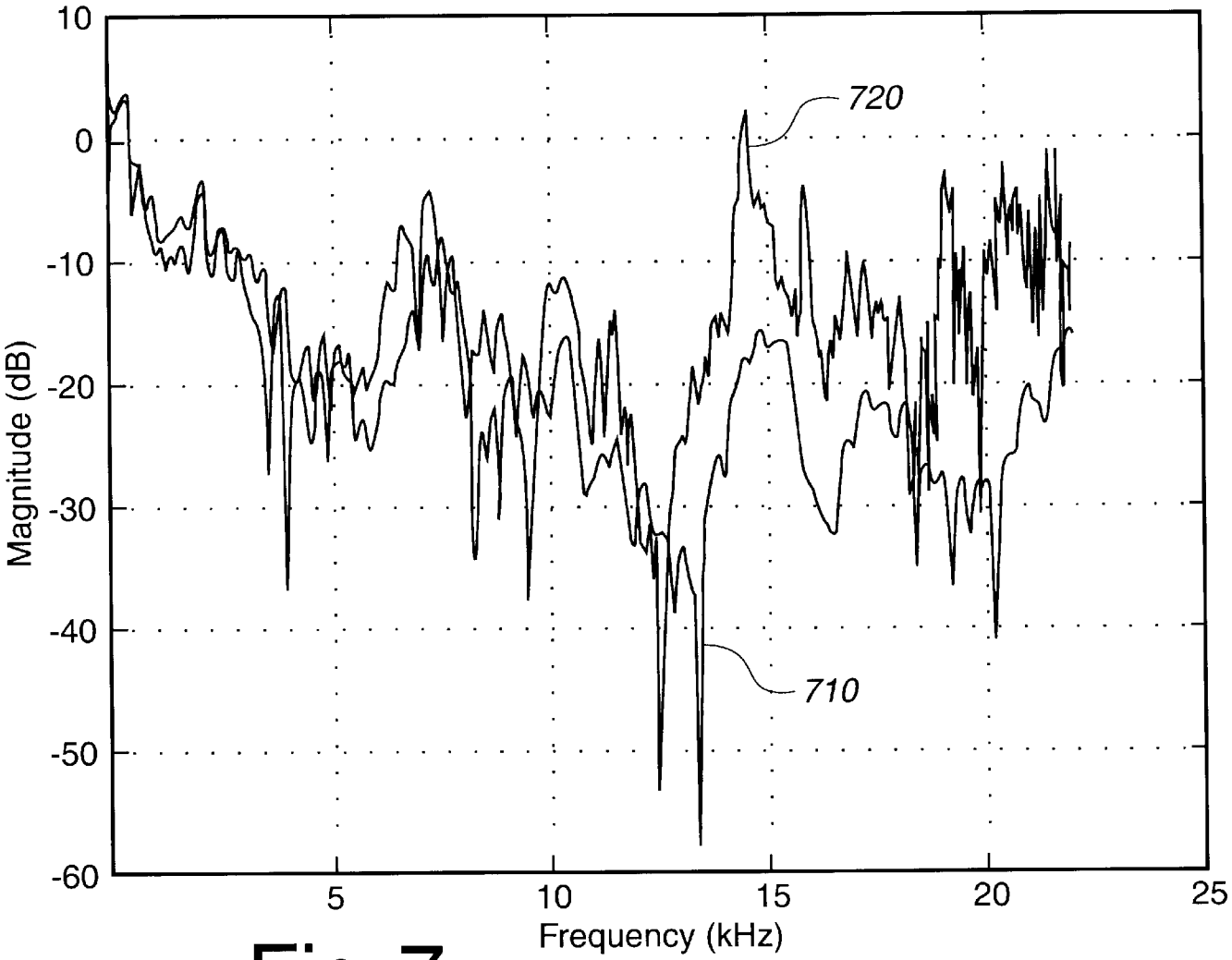
FIG. 7A is a graph which plots the magnitude frequency response of C30 and the magnitude frequency response of C0.

FIG. 7A is a graph which plots the magnitude frequency response of C30 on a curve 710 and the magnitude frequency response of C0 on a curve 720. C0 and C30 are each modeled using a minimum phase filter combined with a pure delay. Note the similarity between the two curves up to about 12 kHz. It would be desirable if a filter could be designed according to a curve that would effectively model both C0 and C30 so that cancellation over the entire 30 degree region could be achieved by varying only the pure delay, which is relatively easy to accomplish electronically.

Figure 7B:
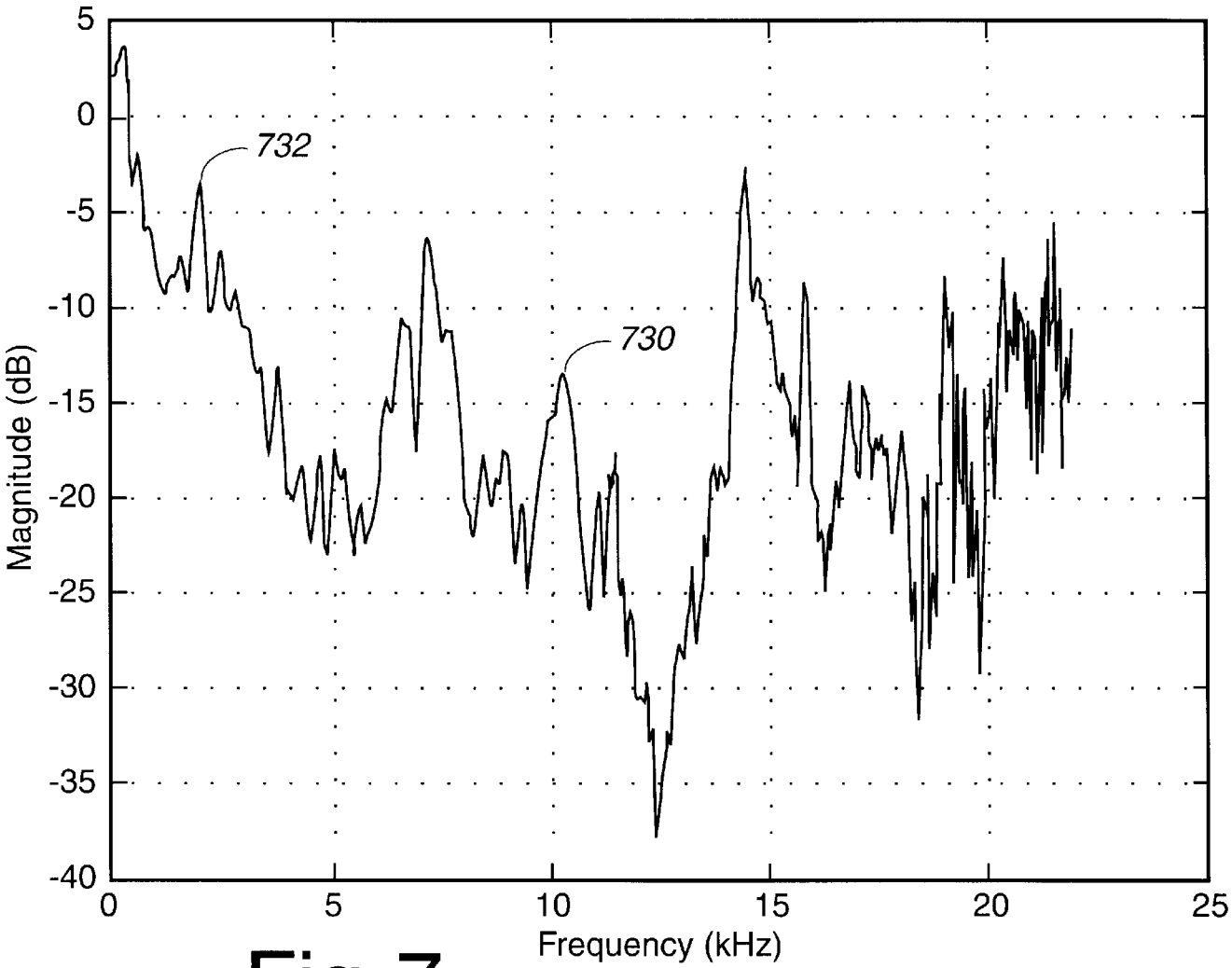
FIG. 7B is a graph which plots the magnitude frequency response for an average of C0 and C30.
Figure 7C:
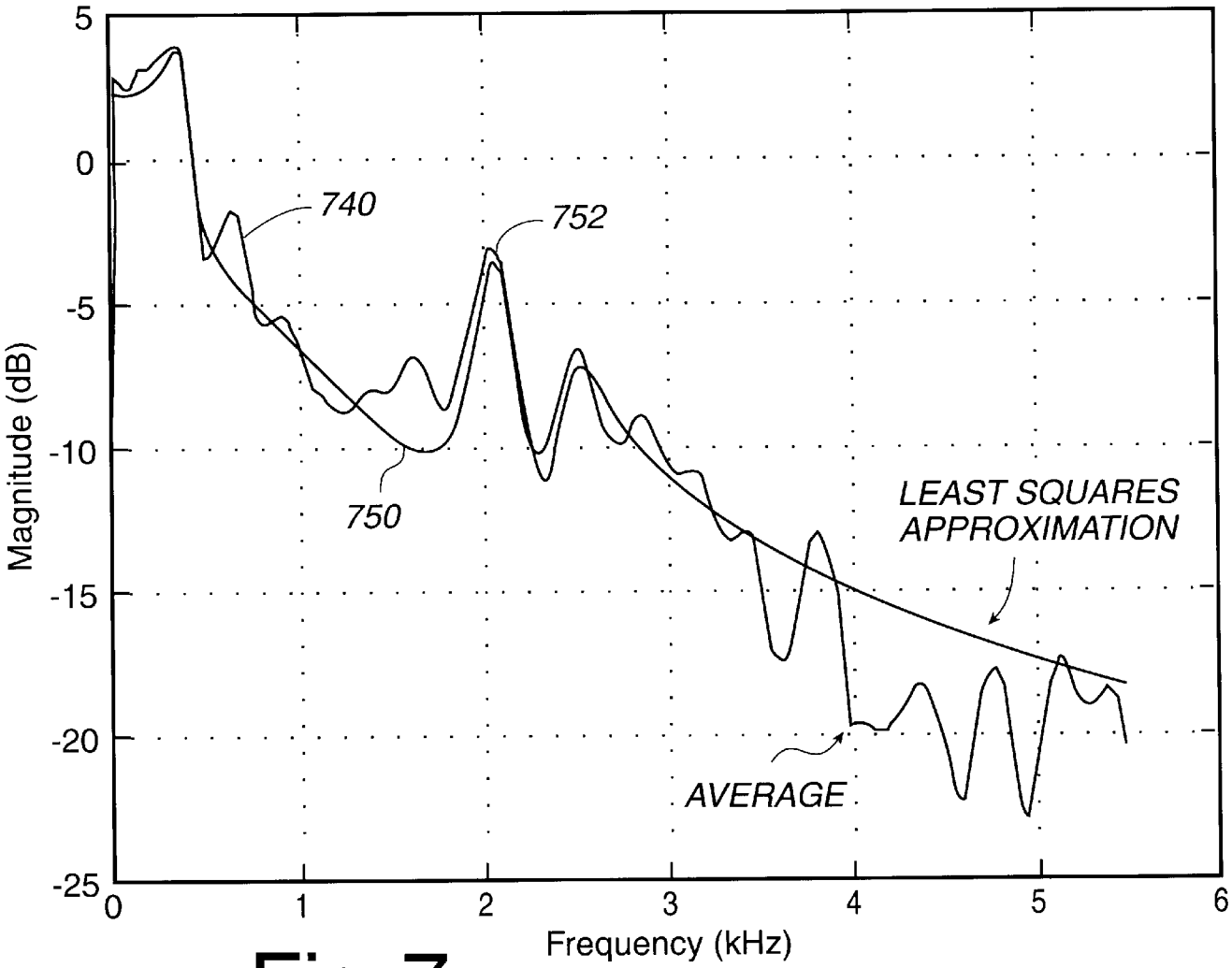
FIG. 7C is a graph which plots the magnitude of a curve which represents only low frequency components.

FIG. 7B is a graph which plots the magnitude frequency response on a curve 730 which represents an average of curve 710 and curve 720. A peak 732 is a feature which is common to both 710 and curve 720. FIG. 7C is a graph which plots the magnitude of a curve 740 which represents only the low frequency components of curve 730. Frequency components above about 5.5 kHz are low pass filtered. A curve 750 fits the average of the low frequency components of curve 740. A fifth order curve fit using a least squares algorithm is used. A difference function is used to ensure that the areas of curve 730 which particularly correspond to common features from curves 710 and 720 such as peak 732 which is modeled by peak 752 are well fit. In other embodiments, other order curve fits are used and curve fitting methods other than least squares are used. A difference function is not used in certain embodiments.

Figure 8A:
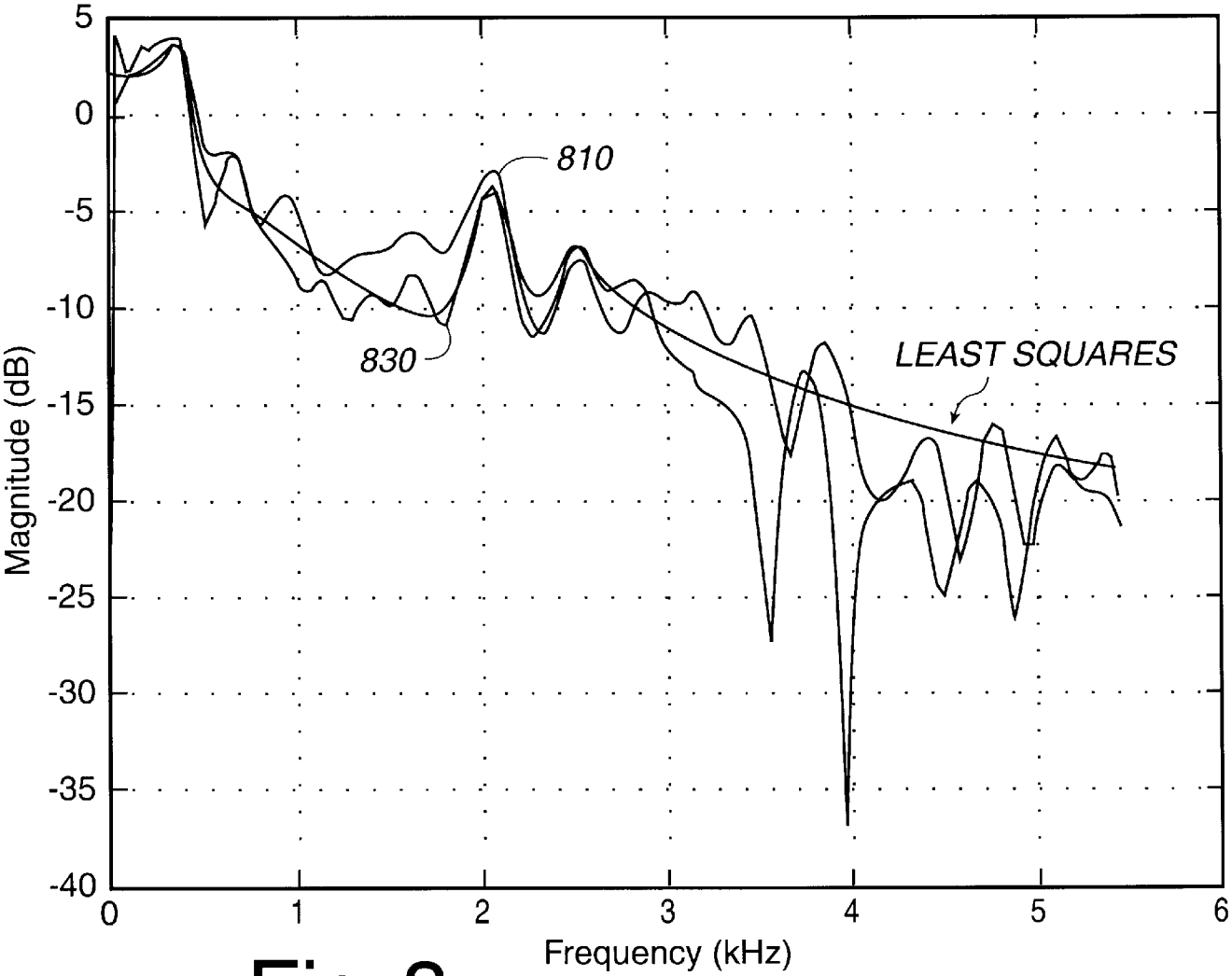
FIG. 8A is a graph which shows the magnitude response of the unsmoothed theoretical design for C0 and C30 together with the smoothed filter design magnitude response.

FIG. 8A is a graph which shows the magnitude response of the unsmoothed theoretical design for C0 on a curve 810 together with the smoothed filter design magnitude response on a curve 820. A curve 830 plots the magnitude response of the unsmoothed theoretical design for C30. As is shown, the magnitude response of both C30 and C0 are well modeled for frequencies below about 5.5 kHz, as is desired.

Figure 8B:
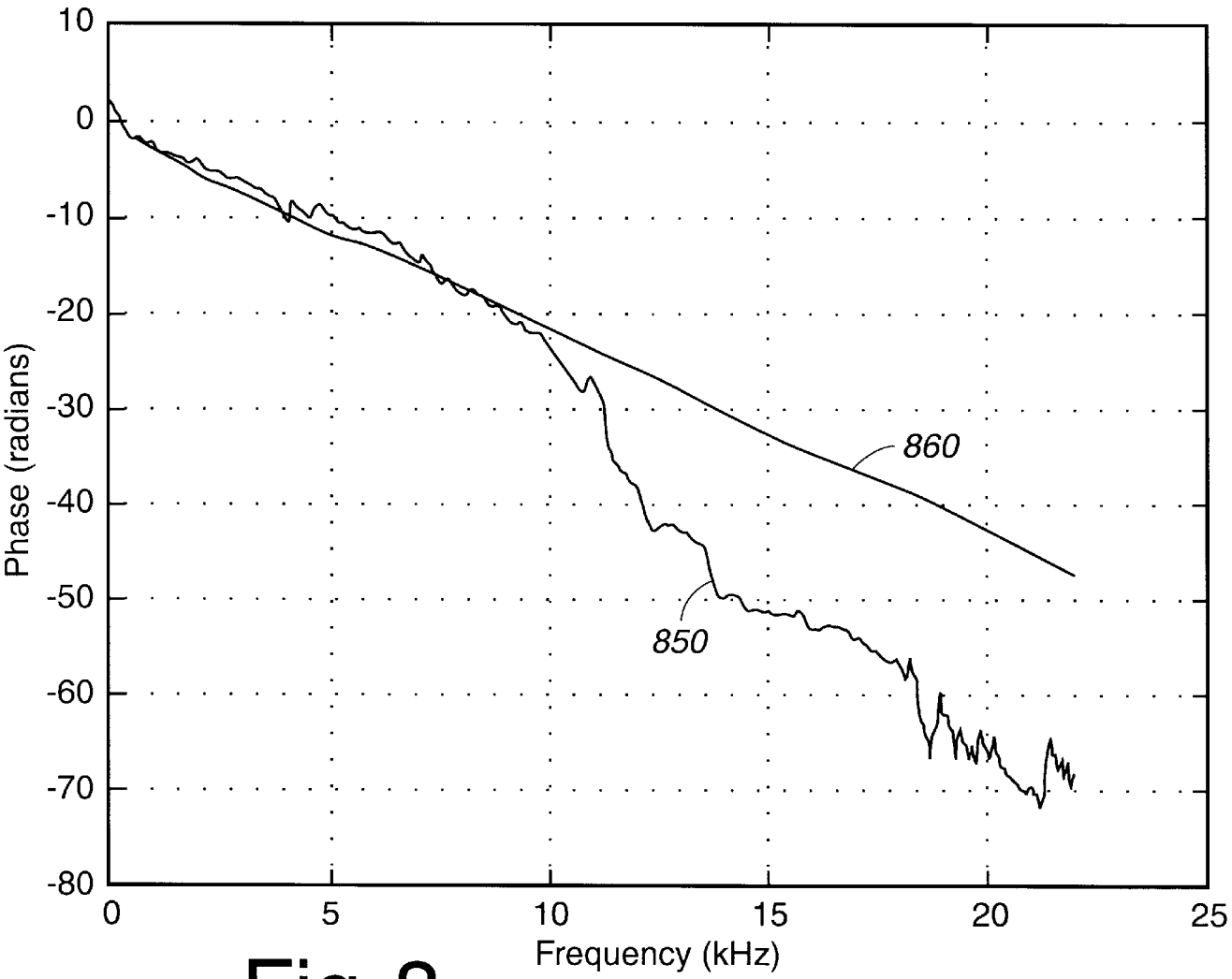
FIG. 8B is a graph which shows the phase response of the minimum phase filter for the smoothed averaged filter C30, combined with a 15 sample time delay.
Figure 8C:
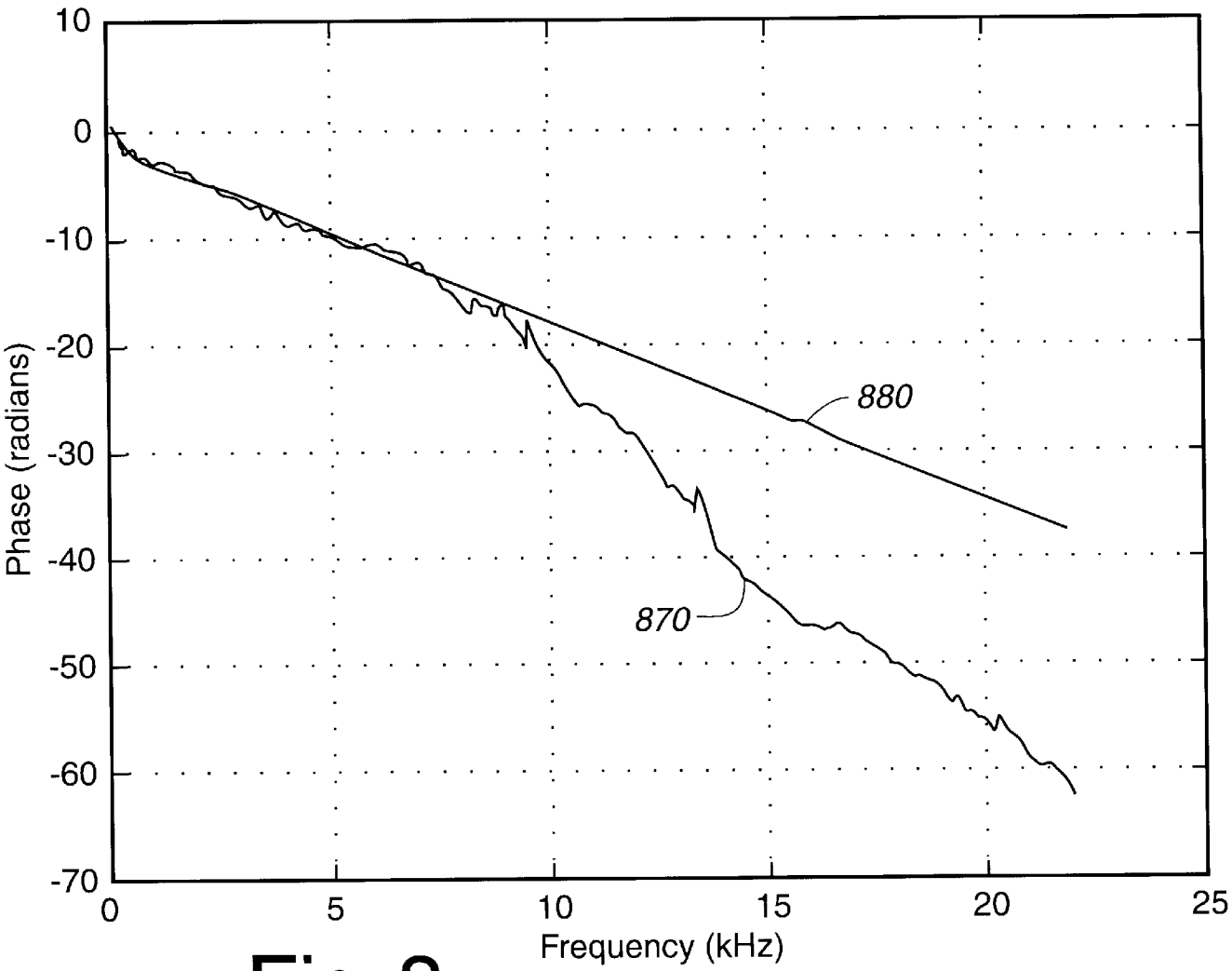
FIG. 8C is a graph which shows the phase response of the minimum phase filter for the smoothed averaged filter C0, combined with a 12 sample time delay.

FIG. 8B is a graph which shows the phase response of the minimum phase filter for the smoothed averaged filter C30, combined with a 15 sample time delay on a curve 850. The phase of the measured transfer function S/D is shown on a curve 860. It is clear that there is very little difference in the region of interest below about 5.5 kHz. FIG. 8C is a graph which shows the phase response of the minimum phase filter for the smoothed averaged filter C0, combined with a 12 sample time delay on a curve 870. The phase of the measured transfer function S/D is shown on a curve 880. It is clear that there is very little difference in the region of interest below about 5.5 kHz.

Thus, it has been shown that a cancellation filter has been designed to implement a cancellation transfer function S/D using a minimum phase filter and a pure delay. Furthermore, it has been shown that the cancellation filter designed has a magnitude response which corresponds to the average of the cancellation transfer functions S/D for 0 degrees and 30 degrees using a least square fit together with a difference function. Finally it has been shown that the designed cancellation filter effectively implements the cancellation transfer function for angles between 0 degrees and 30 degrees with only an adjustment to a pure delay. As noted above, the need to adjust the pure delay is obviated in certain embodiments by positioning the direct speaker and the reflecting speaker very close together or on top of each other.

In addition to smoothing the filter magnitude response curve and averaging the curve over a range of angles, portions of the filter response curve are altered at certain frequencies for certain embodiments of the invention. For example, since low frequency signals less than about 200 Hz have very little effect on human perception of direction and it may be desirable to boost the signal heard by the listener at those bass frequencies, the response of the cancellation filter may be cutoff below 200 Hz so that those frequencies are not canceled. Similarly, the response may be cut off at frequencies other than 5.5 kHz depending on the spectrum of the sound signal which is to be played, for example when higher frequencies are not provided in the surround signal. In certain embodiments, the frequency range of the cancellation filter may be limited or enhanced in other ways to de-emphasize or emphasize certain frequencies.

As described above, in one embodiment, an average of the 30 degree and 0 degree magnitude curves is implemented. In another embodiment a 15 degree curve is used without averaging to determine the magnitude of the cancellation filter. As noted above, in certain embodiments, an adjustment is provided so that the time delay may be adjusted for the actual angle to the listener for a given speaker/listener configuration. The adjustment can be input by a listener by entering the distance from the listener to the speakers and the distance between the speakers, or the angle from the listener to the speakers, or the adjustment can be made by the listener according to the sound heard by the listener at his location. In other embodiments an average delay is implemented without adjustment. As long as the ideal delay does not vary too greatly, this approach provides an acceptable sweet spot.

As noted above, the cause of the phase delay change at different angles relative to the speaker is that as the listener moves, the path length difference from the listener to the reflecting speaker and the direct speaker changes. In certain embodiments, the speakers are positioned within single enclosure in a manner that minimizes the path length difference as the listener moves. This obviates the need to adjust the phase as a function of speaker angle.

Conventional side firing speakers do not provide good results when combined with a virtual speaker system as taught in U.S. patent application Ser. No. 08/303,705 of Abel et. al. and U.S. patent application Ser. No. 08/710,334 of Abel et. al., which are each herein incorporated by reference for all purposes. The leakage signal from the side firing speaker also tends to disturb the listener's perception of the virtual speaker signal. When leakage cancellation as described above is used, a virtual surround speaker signal combined with the reflection surround speaker yields good results. In certain embodiments, a virtual surround system is combined with the reflection sound system with leakage cancellation.

Although the foregoing invention has been described in some detail for purposes of clarity of understanding, it will be apparent that certain changes and modifications may be practiced within the scope of the appended claims. For example, the present invention may be used to cancel leakage from an upwardly directed surround signal or any other reflected signal which has a direct leakage signal associated with it. In certain embodiments, cancellation of the leakage signal from a reflecting speaker is accomplished from a speaker source which is not co-located with the reflecting speaker, although such a system might have a somewhat less large sweet spot since the listener's movement would have a greater effect on the relative difference between two signals emanating from different sources. In general, it should be noted that there are may alternative ways of implementing both the process and apparatus of the present invention. It is therefore intended that the following appended claims be interpreted as including all such alterations, permutations, and equivalents as fall within the spirit and scope of the present invention.

What is claimed is:

1. In a multiple speaker system having a first speaker which is configured to transmit a reflected sound signal to a listener along a reflected path and a second speaker which is configured to transmit a direct sound signal to the listener at a location along a direct path, a method of reducing the listener's perception of a direct leakage signal from the first speaker including:

applying a first speaker input electrical signal to the first speaker, the first speaker being configured to be pointed in a direction away from the listener and having a direct leakage transfer function relative to the listener, the direct leakage transfer function being characterized by a transformation which transforms the first speaker input electrical signal into a first speaker leakage signal at the location of the listener by the radiation of the signal by the first speaker and the propagation of the radiated signal to the listener along a direct path from the first speaker to the listener;

processing a second electrical signal which is derived from the first speaker input electrical signal through an open loop system which has a leakage canceling transfer function, the leakage canceling transfer function being characterized by a transformation which transforms the second electrical signal into a canceling transmission signal which has the property of canceling the first speaker leakage signal at the location of the listener when the canceling transmission signal is transformed into a leakage canceling signal at the location of the listener as a result of being transmitted by the second speaker and propagated to the listener; and applying the canceling transmission signal to the second speaker;

whereby the transmission and propagation of the of the canceling transmission signal from the second speaker to the listener tends to cancel the effect of the direct leakage transmission and propagation of the first input signal from the first speaker.

2. A method as described in claim 1 wherein the second electrical signal is substantially the same as the first speaker leakage signal at frequencies above approximately 200 Hz.

3. A method as described in claim 2 wherein at frequencies above approximately 200 Hz the leakage canceling transfer function is derived from a raw leakage transfer function which is substantially equivalent to the direct leakage transfer function applied to the inverse of a second speaker direct transfer function, the second speaker direct transfer function being characterized by a transformation which transforms a second speaker input signal into a second speaker direct signal at the location of the listener by the radiation of the signal by the second speaker and the propagation of the radiated signal to the listener along a direct path from the second speaker to the listener.

4. A method as described in claim 3 wherein the leakage canceling transfer function is implemented using a digital filter.

5. A method as described in claim 3 wherein at frequencies above approximately 200 Hz the leakage canceling transfer function is derived from a least squares fit of the raw leakage transfer function.

6. A method as described in claim 4 wherein at frequencies above approximately 200 Hz the leakage canceling transfer function is derived from a least squares fit including a difference function of a plurality of raw leakage transfer functions.

7. A method as described in claim 3 wherein at frequencies above approximately 200 Hz the leakage canceling transfer function is expressed as a minimum phase transfer function combined with a pure delay.

8. A method as described in claim 3 and wherein at frequencies above approximately 200 Hz the leakage canceling transfer function is derived from a fit of the raw leakage transfer function which is substantially equivalent to the negative of the direct leakage transfer function applied to the inverse of the second speaker direct transfer function, the fit being specifically characterized by an emphasis on fitting the peaks.

9. A method as described in claim 1 wherein:

the first speaker has a plurality of direct leakage transfer functions relative to a listener, the plurality of direct leakage transfer functions varying with the relative angle from the first speaker to the listener, each direct leakage transfer function being characterized by a transformation which transforms the first speaker input signal into a first speaker leakage signal at a location of the listener by the anisotropic radiation of the signal by the first speaker and the propagation of the anisotropically radiated signal to the listener along a direct path from the first speaker to the listener; and wherein at frequencies above approximately 200 Hz the leakage canceling transfer function is derived from a combination of a plurality of raw leakage transfer functions, each of which is substantially equivalent to the negative of a direct leakage transfer function applied to the inverse of a second speaker direct transfer function.

10. A method as described in claim 1 wherein at frequencies below approximately 200 Hz the leakage canceling transfer function is suppressed.

11. A method as described in claim 1 wherein at frequencies below approximately 200 Hz the gain of the leakage canceling transfer function is less than −10 dB.

12. A method as described in claim 1 wherein the leakage canceling transfer function has a linear phase.

13. A method as described in claim 1 wherein the leakage canceling transfer function has an order which is less than 6.

14. A method as described in claim 1 wherein the ratio of the power of the reflected sound signal at the location of the listener to the power of the uncanceled first speaker leakage signal at the location of the listener is greater than 20 dB and the ratio of the power of the reflected sound signal at the location of the listener to the combined power of the first speaker leakage signal and the leakage canceling signal at the location of the listener is greater than 30 dB.

15. A method as described in claim 1 wherein difference between the ratio of the power of the reflected sound signal at the location of the listener to the power of the uncanceled first speaker leakage signal at the location of the listener and the ratio of the power of the reflected sound signal at the location of the listener to the combined power of the first speaker leakage signal and the leakage canceling signal at the location of the listener is greater than 10 dB.

16. A method as described in claim 1 wherein the first speaker and the second speaker are located in substantially the same location.

17. A method as described in claim 1 wherein the first speaker and the second speaker are located in an integrated speaker unit.

18. A method as described in claim 1 wherein the first speaker is an anisotropic speaker.

19. A method as described in claim 1 wherein the first speaker and the second speaker are in the same speaker enclosure.

20. A method as described in claim 1 wherein the leakage canceling transfer function extends up to approximately 5.5 kHz.

* * * * *